US007021215B2

(12) United States Patent
Schneider et al.

(10) Patent No.: US 7,021,215 B2
(45) Date of Patent: Apr. 4, 2006

(54) METHOD FOR ADJUSTING PRESS SPEED AND INK TEMPERATURE

(75) Inventors: Georg Schneider, Würzburg (DE); Wolfgang Otto Reder, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/495,123

(22) PCT Filed: Nov. 18, 2002

(86) PCT No.: PCT/DE02/04248

§ 371 (c)(1),
(2), (4) Date: May 20, 2004

(87) PCT Pub. No.: WO03/045695

PCT Pub. Date: Jun. 5, 2003

(65) Prior Publication Data

US 2005/0011387 A1 Jan. 20, 2005

(30) Foreign Application Priority Data

Nov. 22, 2001 (DE) ..... 101 57 270
Nov. 22, 2001 (DE) ..... 101 57 271
Apr. 25, 2002 (DE) ..... 102 18 359

(51) Int. Cl.
*B41F 23/04* (2006.01)
*B41F 5/00* (2006.01)
*B41F 16/00* (2006.01)

(52) U.S. Cl. ..... 101/487; 101/142; 101/216

(58) Field of Classification Search ..... 101/487, 101/452, 141, 142, 491, 261, 219, 148, 216
See application file for complete search history.

(56) References Cited

U.S. PATENT DOCUMENTS 3,141,408 A * 7/1964 Bernardi et al. ..... 101/488
3,741,115 A 6/1973 Keller ..... 101/148
3,956,986 A * 5/1976 Wirz et al. ..... 101/350.3
4,304,601 A 12/1981 Sharp ..... 524/261
4,341,156 A 7/1982 Kaeppner ..... 101/141
4,403,550 A 9/1983 Sharp ..... 101/452
4,842,990 A * 6/1989 Herrmann et al. ..... 430/212
4,903,599 A * 2/1990 Kubler et al. ..... 101/450.1
5,295,437 A * 3/1994 Philippe ..... 101/487

(Continued)

FOREIGN PATENT DOCUMENTS

DE 1 953 590 6/1971

(Continued)

OTHER PUBLICATIONS

Helmut Kipphan, Handbook of Print Media, 2001, pp 132-144.*

(Continued)

*Primary Examiner*—Andrew H. Hirshfeld
*Assistant Examiner*—Wasseem H. Hamdan
(74) *Attorney, Agent, or Firm*—Jones Tullar & Cooper, PC

(57) ABSTRACT

A method for operating a printing group and to the use of a printing ink. The tack of an ink that is used in a printing group of a rotating printing press, or the temperature of a rotating component in the printing group is selected or controlled. The ink itself is temperature regulated in response to production speeds to maintain the ink tackiness in the desired range. A gradient that sets forth an interrelationship between ink tackiness, temperature and production speed can be used in a control device for use in temperature regulation.

33 Claims, 4 Drawing Sheets

U.S. PATENT DOCUMENTS

| | | | | |
|---|---|---|---|---|
| 5,452,657 | A * | 9/1995 | Kurz | 101/216 |
| 5,535,674 | A * | 7/1996 | Vrotacoe et al. | 101/216 |
| 5,595,115 | A | 1/1997 | Rau et al. | 101/142 |
| 5,694,848 | A | 12/1997 | Palmatier | 101/219 |
| 5,758,580 | A | 6/1998 | Murray | 101/491 |
| 5,784,957 | A | 7/1998 | Rau et al. | 101/142 |
| 5,807,460 | A * | 9/1998 | Yamamoto | 156/344 |
| 5,810,927 | A * | 9/1998 | Ayres et al. | 118/667 |
| 6,209,456 | B1 | 4/2001 | Murray et al. | 101/487 |
| 6,505,557 | B1 * | 1/2003 | Desaulniers et al. | 101/487 |

FOREIGN PATENT DOCUMENTS

| | | | |
|---|---|---|---|
| DE | 26 24 674 | | 12/1976 |
| DE | 44 31 188 | A1 | 5/1995 |
| DE | 197 36 339 | A1 | 4/1999 |
| EP | 0 652 104 | A1 | 5/1995 |
| EP | 0 886 578 | B1 | 5/2001 |
| JP | 62-191152 | | 8/1987 |
| WO | WO 97/33751 | | 9/1997 |

OTHER PUBLICATIONS

Pyliotis, D.; "Ursachen von Schwankungen der Druckqualitat im Offsetdruck bei konstanter Farbwerktemperatur"; FOGRA 1977; pp. 1-16; Munich, Germany.

Gluck, Michael; "Temperaturen in Walzenfarbwerken"; 1973; pp. 9-20; Germany.

ISO 12634; "Graphic technology—Determination of tack of paste inks and vehicles by a rotary tackmeter"; International Organization for Standardization; 1996, pp. 1-4; Switzerland.

Walenski, Wolfgang; "Der Rollen Offset druck"; 1995; pp. 321-323; Germany.

Walenski, Wolfgang; "Der Rollen Offset druck—Druckfarben fur den Rollenoffsetdruck"; 1995; pp. 148-157; Germany.

* cited by examiner a)

| Production Speed [m/s] | Reference Variable T-soll/Maximum Value T-max [°C] |
|---|---|
| | |
| 1 - 4 | 20 - 25 |
| 4 - 6,5 | 26 - 31 |
| 6,5 - 9 | 30 - 35 |
| 9 - 14 | 32 - 37 |

METHOD FOR ADJUSTING PRESS SPEED AND INK TEMPERATURE

FIELD OF THE INVENTION

The present invention is directed to a method for operating a printing group and to the use of a printing ink. The temperature of a printing component, or of an ink used in the printing is controlled as a function of production speed.

DESCRIPTION OF THE PRIOR ART

A regulating process is known from JP 62-191152. Cooling of a roller, to change the roller temperature, is turned on or off as a function of the operational status of the printing press. In the course of printing, the roller temperature is regulated as a function of the surface temperature of a forme cylinder.

EP 0 652 104 A1 discloses a printing group for waterless offset printing having various options for the temperature regulation of the surface of cylinders. For example, during the preparation of the printing group for printing operations, pre-warming is possible. During printing, the maintenance in a defined temperature range of a printing plate on the forme cylinder at a constant temperature of 28 to 30° C., for example is possible.

A temperature regulation of the plate and transfer cylinders as a prerequisite for printing high-quality printed products is also mentioned in the literature of this field, for example in Walenski, der Rollenoffsetdruck 1995 (sheet-fed offset printing), in connection with waterless offset printing. The temperature of the printing plate should be maintained constant at 25 to 28° C. For newspaper printing, suitable tackiness values of 3.5 to 5 tack were recited for reason of tackiness.

A printing group is disclosed in EP 0 886 578 B1. An inking unit and the ink-conducting cylinders are arranged in a partially enclosed space. To prevent scumming on the one side, and drying out of the printing ink on the other side, the partially enclosed space is maintained at a pre-determinable temperature and at a defined level of humidity of the air, or a concentration of chemical substrates. For example, the entire space may be maintained at a desired value of 33.8° C., a humidity of 75% and/or a concentration of the chemicals of 300 ppm.

DE-OS 19 53 590 discloses a printing group with an inking unit and a dampening unit. The temperature can be regulated by use of a temperature regulating device. Prior to starting the printing operation, it is possible to set a reference variable of the temperature as a function of influencing variables, for example the printing speed by use of a test print or of tables. Room temperature is disclosed as an advantageous upper limit of the temperature of the printing ink.

The FOGRA-Forschungsbericht (Research Report) 3.220 deals with the temperature regulation of an inking unit in a sheet-fed offset machine. Here, an even temperature range is obtained, for example, with constant inking unit temperatures. The ink transfer, for example the tackiness, can be adjusted by changing the inking unit temperature. For example, for a defined printing ink it is necessary to set a temperature of approximately 35° C. on the surface of a distribution cylinder of the inking unit in order to prevent plucking in connection with a defined setting of the amount of dampening agent. A representation of measurement results shows values of the determined tackiness as a function of the amount of dampening agent, as well as a plucking limit of 6.5 N/m.

A temperature-regulating device in a printing group is known from DE 197 36 339 A1. The rheologic properties, such as the tackiness inter alia, are affected by the temperature regulation.

A printing forme of a printing group for waterless offset printing is cooled to approximately 28 to 30° C. by a cooling device in DE 44 31 188 A1.

A prescription for the measurement of tackiness of pasty inks exists in ISO 12634: 1996 (E). The "Prüfbau Inkomat" is mentioned as one of several suitable measuring devices.

SUMMARY OF THE INVENTION

The object of the present invention is directed to providing a printing ink in a printing group, and a printing group of a rotary printing press.

In accordance with the present invention, this object is attained by operating a printing group such as one used for waterless planographic printing, in which the temperature of a rotating structural component, or the temperature close to the surface of a rotating structural component, which rotating structural component is working with printing ink, is controlled. The control is a function of the production speed of the printing group. A control device is used in conjunction with a determined relationship between speed and temperature. A tackiness of the ink is maintained constant, by this temperature regulation, over varying speeds. The ink tackiness may be set between 6 and 9.5 tack.

The advantages to be gained by the present invention reside, in particular, in that a high print quality and an interference-free operation are achieved, both at low and high production speeds.

The method and the device of the present invention are particularly suited for application in waterless offset printing, since, in connection with this printing process in particular, the buildup of printing ink and the soiling on the ink-conducting structural components represents a problem. Because of the lack of dampening agent, and for other reasons, an increased temperature, and possibly too high a temperature for the printing process or for the printing inks used, can occur in the printing group. Because of the lack of a dampening agent, soiling, paper dust and fibers can possibly not be effectively removed from the printing process.

The buildup of printing ink and soiling on the one side, and tackiness, or a plugging of the printing forme because of "wrong" temperatures on the other side, are effectively reduced, and in the ideal case prevented.

It is also advantageous that, by use of the method or the device of the present invention, it is possible to provide an ideal adaptation to various printing inks and/or materials to be imprinted. By use of the regulation of the temperature, the interfering plucking between the ink transfer cylinder and the material to be imprinted can be effective prevented or reduced.

In an advantageous embodiment of the invention, the forme cylinder of the printing group is temperature-regulated. This is accomplished without the additional generation of a gas flow on its surface from the direction of the forme cylinder, such as occurs with a temperature-regulating agent, evaporation agent, etc. being introduced into the forme cylinder, for example. Because of this, the accelerated evaporation of ink-containing materials and any premature drying can be prevented. Also, clearly reduced demands are made on setting a special room climate, as well as on possibly required exhaust air cleaning.

It is particularly efficient and simple if only the forme cylinder, or cylinders of the printing group is or are temperature- regulated, without the additional temperature regulation of the transfer cylinder. However, the inking unit can additionally have a temperature regulation.

Moreover, a considerable savings in energy, in comparison with conventional methods, is possible, wherein the cylinders are maintained at a single, fixed low temperature, for example.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
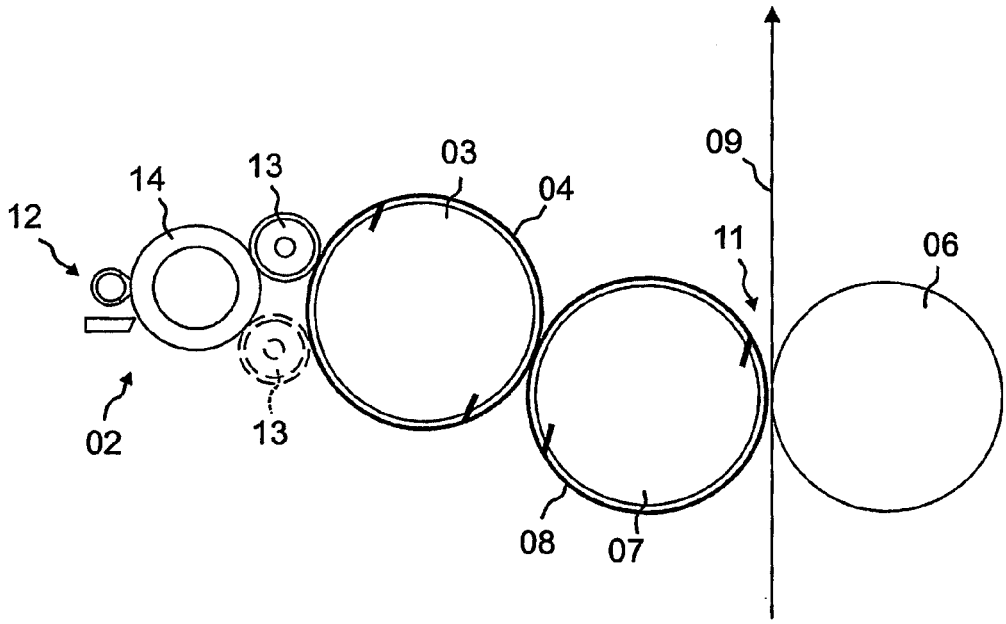
FIG. 1, a schematic representation of a printing group for waterless offset printing in accordance with the present invention, FIG. 2, a schematic representation of interrelationships between temperature, tackiness, as well as production speed, in FIG. 3, a preferred embodiment of a regulating diagram, FIG. 4, depictions of a pre-setting of a reference variable a) in the form of a table, b) as a step function, c) as a constant curve, and in FIG. 5, a diagram of the characteristics of an ink used.

A printing press, in particular a rotary printing press, as shown in FIG. 1, has a printing group 01, which contains at least one inking unit 02, a cylinder 03 supporting a printing forme 04, for example a printing group cylinder 03 configured as a forme cylinder 03, as well as a counter-pressure cylinder 06. The printing forme 04 is preferably embodied as a printing forme 04 for planographic printing; i.e. as a planographic printing forme 04, in particular for use in waterless planographic printing; i.e. as a waterless planographic printing forme 04. The printing group 01 is configured, for example, as a printing group 01 for offset printing and has, between the forme cylinder 03 and the counter-pressure cylinder 06, a further cylinder 07, for example a printing group cylinder 07 embodied as transfer cylinder 07, with a dressing 08 on its jacket surface. In a print-on position of the printing group, the transfer cylinder 07, together with the counter-pressure cylinder 06, constitutes a printing position 11 for a material 09 to be imprinted, for example a web 09 to be imprinted. The counter-pressure cylinder 06 can be a second transfer cylinder 06, which is part of an unidentified and not depicted printing group, or it can be a counter-pressure cylinder 06, for example a steel or satellite cylinder, which does not conduct printing ink.

The printing forme 04 can be embodied in a sleeve shape, or as one, or as several printing plates 04, which are fastened or suspended by their ends in a narrow groove, having a width not exceeding 3 mm in the circumferential direction as depicted schematically in FIG. 1. The dressing 08 on the transfer cylinder 07 can also be configured to be sleeve-shaped or as at least one rubber blanket 08, which is also fastened and/or clamped in at least one groove on the transfer cylinder 07. If the rubber blanket 08 is embodied as a multi-layered metal printing blanket, the groove is also embodied to have the maximum width discussed in conjunction with the forme cylinder 03.

The inking unit 02 has an ink supply device 12, for example an ink trough with a dipping roller or lifter, or a chamber doctor blade with an ink feed, as well as at least one roller 13, which can be placed against the forme cylinder 03 in a print-on position, for example an application roller 13. In the printing unit 01 of FIG. 1, the printing ink is transported from the ink supply device 12 via a roller 14, embodied as a screen roller 14, to the ink application roller 13, then to the forme cylinder 03 and to the transfer cylinder 07 and finally to the material 09 to be imprinted, the material 09 being, for example, in a web form or as a sheet. It is also possible to arrange a second ink application roller 13, represented in dashed lines in FIG. 1, which second ink application roller 13 also cooperates with the screen roller 14 and the forme cylinder 03.

The printing group 01 is configured as a so-called "printing group for waterless planographic printing", and in particular for "waterless offset printing" or "dry offset". Besides the supply of printing ink, no further supply of a dampening agent for establishing "non-printing" areas is required. With this printing method, the application of a moisture film on the printing forme 04 can be omitted, which moisture film in connection with so-called "wet offset" method of printing, prevents the non-printing parts on the printing forme 04 from absorbing printing ink. This non-absorption of printing ink is achieved, in waterless offset printing, by the use of special printing inks and by the special design of the surface of the printing forme 04. For example, in waterless offset printing, a silicone layer on the printing forme 04 can take on the role of the hydrophilic area, which hydrophilic area can be covered with the dampening agent in wet offset printing, and which silicone layer prevents those areas of the printing forme 04 from picking up ink.

In general, the non-printing areas and the printing areas of the printing forme 04 are achieved by the embodiment of areas of the printing forme 04 with different surface tensions and with reciprocal actions with the printing ink.

For scum-free printing, i.e. for printing without the non-printing areas also picking up printing ink and possibly even being plugged with ink, a printing ink is required whose tackiness, measured as a tack value, has been set in such a way that, because of the difference in surface tension, a perfect separation between printing and non-printing parts on the printing plate or printing forme can take place. Since the non-printing areas are preferably embodied as silicon layers, a printing ink with a clearly increased tackiness, compared with wet offset printing, is required for this purpose.

For example, in accordance with "Der Rollenoffsetdruck" (sheet-fed offset printing), by Walenski 1995, tackiness represents the resistance with which a printing ink counteracts the ink film splitting in a roller groove, or the film splitting that occurs in the course of transferring the printing ink in the printing zone between the cylinder and the material to be imprinted. In roller systems, ink tack or tackiness is usually determined by the use of a "Tack-o-scope" or a "Tackmeter", for example.

Since the tackiness of a printing ink changes as a function of temperature, in actual use, the cylinders 03, 07, or the inking system 02, are typically cooled or are maintained at a constant temperature during the operation of the printing press. This is done in order to prevent scumming, under changing operational conditions, during printing.

The tackiness of the printing ink affects, in addition to the separation of printing and non-printing areas, also the severity of plucking during the interaction of an ink-conducting cylinder 03, 07 and the material 09 to be imprinted. In particular, if the material 09 to be imprinted is embodied as uncoated, little compressed newsprint of very good absorbent qualities, i.e. if the material 09 is open-pored and with very short ink-absorbing times, the danger of the release of fibers or dust caused by plucking is increased. This danger also exists, for example, in connection with slightly coated or with light-weight coated paper types with a coating weight of, for example, 5 to 20 g/m$^2$, and in particular with a coating weight of 5 to 10 g/m$^2$ or less, and used in web-fed offset printing. Temperature regulation is suitable, in particular, for printing uncoated paper or coated paper of a coating weight of less than 20 g/m$^2$. The method of the present invention can possibly be advantageous for use with coated paper if it is determined that the coating is "pulled off", or is at least partially pulled off the paper by increased ink tackiness.

In order to keep plucking or buildup on the printing blanket and on the printing plate 04 as low as possible, an attempt is made to produce and to employ printing ink having a tackiness as close as possible to the lower limit of tackiness in accordance with the intended use and the expected operating conditions.

Regarding scumming, or the plugging of the non-printing areas of the printing forme 04, the relative speed of the separation process, i.e. the splitting or loosening of the printing ink, plays a decisive role, in addition to the tackiness of the printing ink. At an increased production speed V, which production speed V corresponds to the surface or to the roll-off speed V of the printing cylinder 03, 07, or to the conveying speed of the material 09 to be imprinted, measured in m/s, the printing ink generates greater tearing forces in the gaps between the roller 13 and the printing forme 04 of the forme cylinder 03, as well as between the printing forme 04 of the forme cylinder 03 and the dressing 08 on the transfer cylinder 07. The lower the relative speed, such as, for example the lower the intended production speed V, the higher the tackiness of the printing ink must be in order to prevent scumming at these lower production speeds V. The wrong selection of ink tack or tackiness leads to poorer print quality or, during the start-up phases, leads to an increased occurrence of waste and to a large outlay for maintenance.

If the dynamic ink tackiness is increased with increasing production speed V, as a rule, increased plucking of the material 09 to be imprinted and an increased buildup of soiling and printing ink occurs on the printing forme 04. If the tackiness had been chosen or selected for a lower or a medium range of the production speed V, this results in complications and an increased maintenance frequency, for example frequent washing of the surface at increased production speeds.

The interrelationship of these problems, which can not be solved solely by a special selection of the printing ink, has been recognized and is solved by the method in accordance with the present invention, as is described in what follows, and by the device for regulation also in accordance with the invention. By the of the method and the device, plucking, and the introduction of fibers and dust into the printing group 01 is prevented, or is at least reduced, in every range of the production speed V. At the same time, scumming of the printing forme 04 is prevented and a high print quality is achieved in every range of the production speed V.

One or more of the ink-conducting structural components such as, in an advantageous embodiment, the printing group cylinder 03, embodied as a forme cylinder 03, as the ink-conducting structural component 03, and/or the printing ink itself, are temperature-regulated as a function of the production speed V. In contrast to what is customary in the field of waterless offset printing, the temperature T is not maintained constant within a definite temperature range for all production speeds V, but has different reference variables $T_{soll}$ for different production speeds. The temperature T is regulated as a function of the production speed V in such a way that the tackiness of the printing ink lies within a predeterminable window of tolerable tack values at every desired production speed V. An increased reference variable $T_{soll}$ is selected for the temperature T of the appropriate structural component 03, or of the printing ink, at a higher production speed V.

Figure 2:
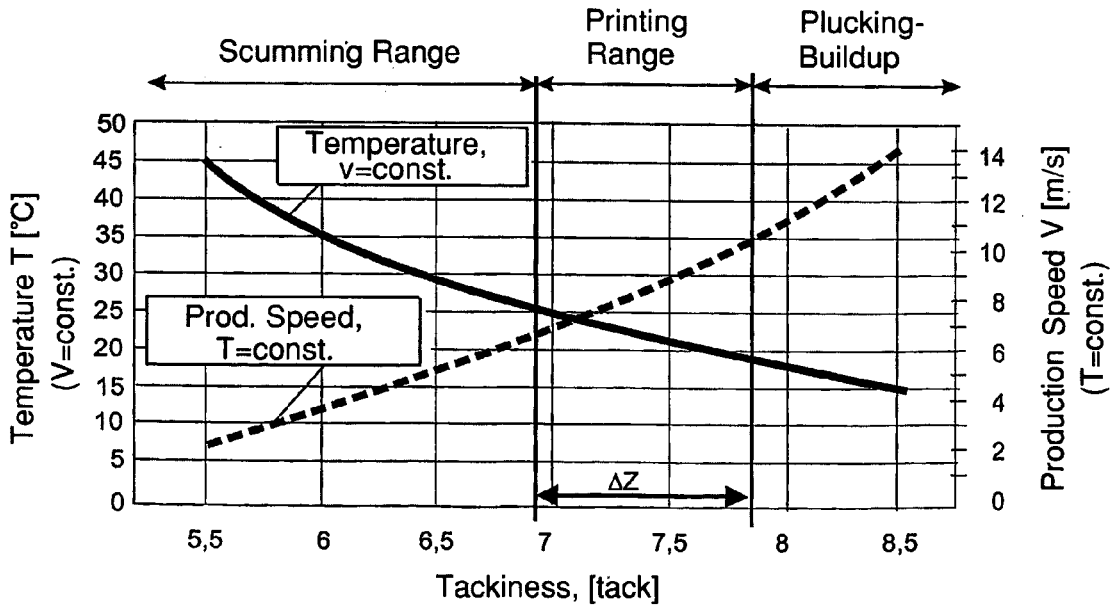

An example of the functions of the interrelationships between the temperature T and the tackiness or tack value, as well as between the production speed V and the tackiness or tack value, is schematically represented in FIG. 2. Regardless of the size and the scale division between the tack values, the tack values fall with increasing temperature T and rise with increasing production speeds V. The two curves of the temperature T and the production speed V depicted in FIG. 2 each represent merely one curve out of a whole family of curves. The curve of the temperature T represents the dependence of the tack value, as a function of the temperature T, at a constant production speed V, while the curve of the changing production speed V represents a curve of the ink tack for a constant temperature T.

A tackiness or tack value Z, sufficient for printing, lies within a "printing range" of tack values, i.e. within a window Delta Z. As a rule, the boundaries of the window Delta Z are soft, i.e. in case of an excess of a tack value below or above the printing range, the print quality is not reduced abruptly, but degrades slowly. The tack values determined, for example, by ink manufacturers for the respective printing ink, however, depend on the measuring device used and also on the method used, so that the dependence and the window Delta Z shown in FIG. 2 must be appropriately converted to each other in connection with different methods and measuring devices.

The values represented by way of example in FIG. 2 show the dependence only schematically by use of a single curve taking the place of the family of curves. However, the values for a suitable window Delta Z are based on the use of an "Inkomat" which is a product of the Prüfbau company. For values to be determined in other ways, they must be converted in accordance with the above mentioned ones.

Besides the tack value, the above described tearing behavior of the ink can also be a function of the radius of curvature of the cooperating surfaces, so that here, in case of considerably, such as twice as large cylinders 03, 07, i.e. with a circumference of approximately 800 to 1,200 mm, the desired window or range Delta Z for the tack value can also be easily displaced.

The window Delta Z for tackiness for interference-free printing by waterless offset lies, for example, between 6 and 9.5, and in particular lies between 7 and 8.5. When reducing the ink tackiness, increased scumming occurs in the "scumming range". In case of an increase in a range of the tackiness Z, "plucking-buildup"; i.e. increased plucking and increased buildup on the cylinders 03, 07 occurs.

The method in accordance with the present invention is based on the regulating principle that for an intended, immediately next, or an actual production speed V, a defined reference variable $T_{SOLL}$, or a maximum value $T_{MAX}$ is assigned as the command value for the temperature T of the structural component 03, or of the printing ink, as the initial temperature value. In both cases, the reference variable $T_{SOLL}$, or the maximum value $T_{MAX}$ represents a preset temperature $T_V$ which preset temperature $T_V$, in the first case corresponds to a temperature to be maintained, or in the second case corresponds an upper limit of a permissible temperature.

Figure 3:
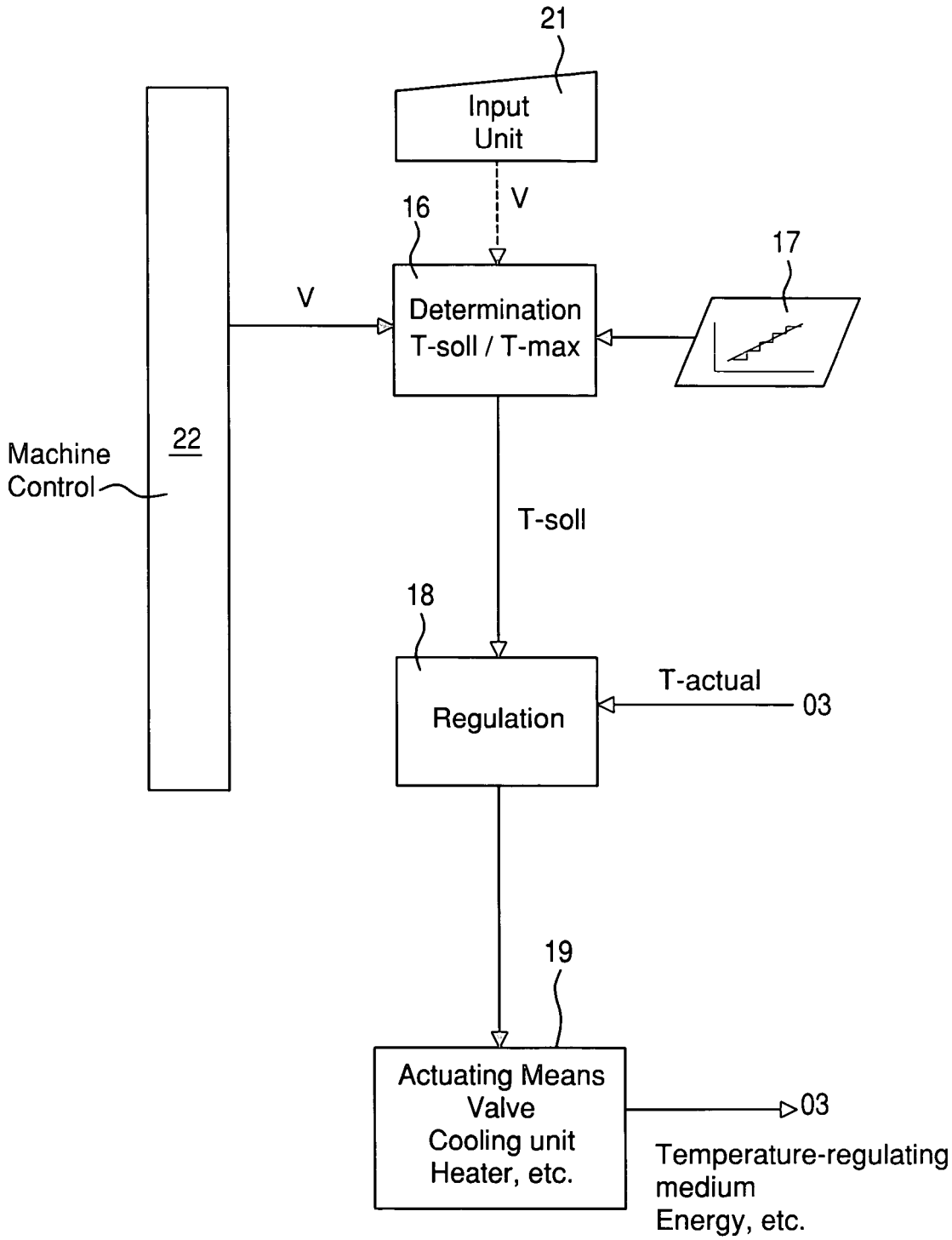

As shown by way of example in FIG. 3, this control can be done by the use [means] of a regulating chain wherein, for example, the production speed V is supplied as the command value to a control device 16. In response, the required reference variable $T_{SOLL}$, or a maximum value $T_{MAX}$, which should not be exceeded, is calculated for the temperature T in the control device 16 by use of a stored interrelationship 17 between the production speed V and the command variable $T_{SOLL}$. This value for the temperature T is supplied, as the command value, and is supplied to a regulating device 18 as the command value. As a regulating value on a regulating system 19, this regulating device 18 maintains the temperature T of the structural component 03, or of the printing ink, constant at the reference variable $T_{SOLL}$, or sees to it that the temperature T does not exceed the maximum value $T_{MAX}$. The temperature T in the area close to the surface of the structural component 03, in particular the temperature T of a jacket surface acting together with the printing ink, or the temperature of the dressing 04, are to be preferably understood as the temperature T of a structural component 03. The measurement of the temperature T is, for example, performed by the use of at least one sensor that is arranged at the structural component 03 or the dressing 04.

The structural component 03, or the printing ink can be brought to the appropriate temperature T as the regulating value by the use of a conventional regulating device 18 via, for example, a cooling and/or a heating unit, a temperature-regulating circuit, by the variation of a temperature-regulating circuit, possibly also by blowing in an appropriately temperature-regulated or flow-regulated gas/air flow, or by other customary methods, each of which can be used as the regulating system 19. Since, in the course of waterless offset printing, the printing group 01 often heats up more than desired because of the lack of a cooling effect of the dampening agent, in this case only a cooling device 19 for temperature regulation needs to be provided as the regulating system 19, which brings the structural component 03, or the printing ink, up to the reference variable $T_{SOLL}$ corresponding to the production speed V, or maintains it at this temperature. In this case, it is possible to assign the maximum value $T_{MAX}$ for the temperature T to each production speed V in place of the reference variable $T_{SOLL}$, which is then monitored and maintained by use of the regulating device 18.

The information regarding the desired and/or the actual production speed V can be provided, for example, manually by an input in an input unit 21, which is in operative connection with the control device 16, and which can be adjusted, in the further course, by the values of a machine control 22. Instead of a manual input, it is advantageous to take the data for the desired and/or actual production speed V from a program flow of the machine control 22, on which production is based.

The control device 16 and the regulating device 18 can be structurally combined and integrated into machine control 22, or into the structural configuration of the regulating system 19.

In a simplified embodiment of the present invention, it is possible, in place of the control device 16, to provide the option of pre-setting the reference variable $T_{SOLL}$ or the maximum value $T_{MAX}$ as the command value for the regulating device 18 in other ways, for example by a manual selection. In this case, the selection of the reference value $T_{SOLL}$ or of the maximum value $T_{MAX}$ made, for example by the printer, is based on the above mentioned interrelationship 17, which is set forth possibly in the form of a table.

In another simplified embodiment of the present invention there is, for example, a control device 16, by use of which the temperature T is set on the basis of experimental values without a subsequent regulating circuit. In this case, a temperature regulation to the reference variable $T_{SOLL}$ or to the maximum value $T_{MAX}$ can take place, for example, without the requirement of a measuring point at the cylinder 03 or at the printing form 04. In this case, the temperatures resulting from defined operating conditions and settings of the temperature regulation are known, for example, from previous calibration measurements. However, an internal regulating circuit for temperature control of the temperature-regulating device itself can yet be provided.

Figure 4:
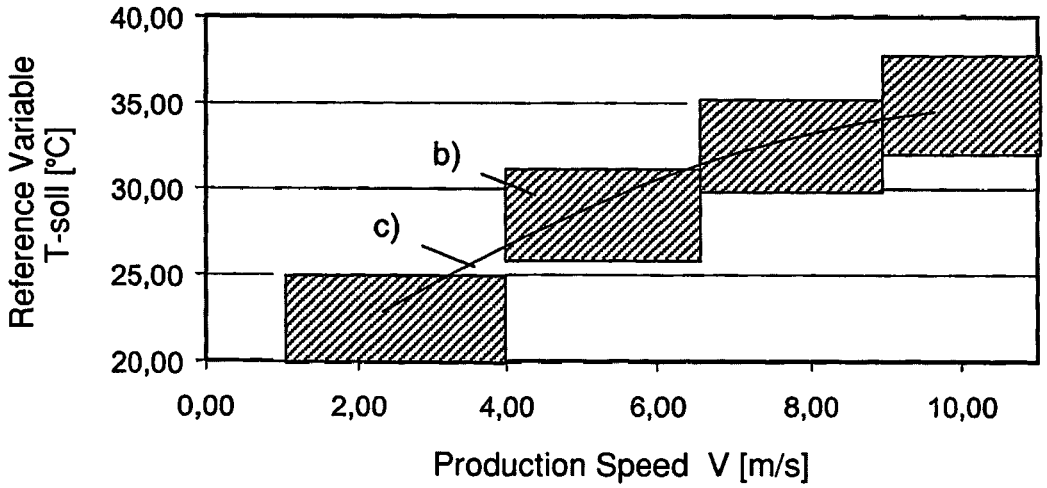

FIG. 4 shows, by way of example and schematically, an interrelationship 17, such as can be stored in a regulating diagram in accordance with FIG. 3 in or for the control device 16. This interrelationship 17 is depicted in the form of a table a), in the form of a sectionally-defined step function b), or in the form of a continuous, monotonously rising function c), in a memory unit or a computer, which is not specifically represented. It is possible to store interrelationships 17, which differ from each other, for printing inks of various "base consistency", for example for inks received from different manufacturers or of different composition. This also applies to different colors of the printing ink.

Depending on the structural component to be temperature-regulated, for example the forme cylinder 03, the transfer cylinder 07, the ink supply 12, the application roller 13, the screen roller 14, selected as the ink-conducting structural component 03, 07, 12, 13, 14, or the printing ink itself, such a table can have various values.

In an advantageous embodiment of the present invention, the forme cylinder 03 of the printing group 01 is temperature-regulated by the method and the device of the present invention, since this meets, in an effective way and with minimal outlay, the requirement for scum-free printing on one side, as well as of the reduction or prevention of plucking on the other side. In contrast to only providing the temperature regulation of the inking unit 02, the temperature regulation of the forme cylinder 03 is performed near the printing forme 04, as well as at a sufficient closeness to the printing position 11 acting together with the material 09 to be imprinted. On the other hand, it is advantageous, in view of the cost outlay and the effectiveness, if only the forme cylinder 03 of the two printing group cylinders 03, 07 is directly temperature-regulated. The desired gradient of the temperatures of the forme and transfer cylinders 03, 07 is achieved in this embodiment under the selected conditions. Temperature regulation of the transfer cylinder 07 from the direction of the interior of that cylinder would possibly be sluggish.

In the case of a non-steady interrelationship 17 as shown in FIG. 4, at "b", for example in a lower range of the production speed V, for example in a production speed range between 1 to 4 m/s, the forme cylinder 03 is temperature-regulated to a temperature T of approximately 20 to 25° C., and in particular to a range of 21 to 23° C. For higher production speeds V, a higher reference variable $T_{SOLL}$ or maximum value $T_{MAX}$ is assigned to the temperature T which, for example for production speeds V of 4 to 6.5 m/s, lies between 26 and 31° C., and in particular between 27 and 29° C. For production speeds V of more than 6.5 m/s, in particular more than 10 m/s, reference variables $T_{SOLL}$, or maximum values $T_{MAX}$, for example, which are greater than 30° C., or even greater than 32° C., are assigned to the temperature T of the forme cylinder 03.

For example, if the production speed V lies between 6.5 and 11 m/s, it is possible to assign a reference variable $T_{SOLL}$, or a maximum value $T_{MAX}$, in the range of greater than 30 to 37° C. In a finer graduation, a range greater than 30 to 35° C. for production speeds V of 6.5 to 9 m/s, for example, and for production speeds V of 9 to 14 m/s a reference variable $T_{SOLL}$, or a maximum value $T_{MAX}$, of approximately 32 to 37° C., for example 34 to 36° C., or even greater than or equal to 35° C., can be assigned. For still higher production speeds V, values of the temperature T exceeding this can be assigned. It is also possible to subdivide the present range from 1 to 14 m/s into fewer, for example only two or three steps, or into more steps, to each of which a temperature T is to be assigned. It can also be advantageous to store the interrelationship as a steady function, such as shown in FIG. 4 at line "c", by way of example.

If other conditions should prevail, for example in connection with printing inks with substantially different properties, in connection with a material 09 to be imprinted having a surface structure which is substantially different from uncoated newsprint, and/or with a completely different plucking behavior, the values of the interrelations 17 can substantially differ from the mentioned values. Yet the regulation of the temperature T of the forme cylinder as a function of the production speed V is common to the solution in such a way that, in a range of higher production speeds V, it has a higher reference variable $T_{SOLL}$, or a maximum value $T_{MAX}$, than for the range of lower production speeds V. Thus, the plucking between the ink-conducting cylinders 03, 07 and the material 09 to be imprinted is reduced by use of the present method and the device in accordance with the invention, and in the ideal case it is almost prevented.

In connection with high production speeds V, for example starting at 6.5 m/s, in particular starting at 10 m/s, it is of particular advantage that, in contrast to solutions proposed up to now, the temperature T may be set to values of more than 30° C. Only by the use of this is it possible to effectively prevent plucking, and the soiling connected therewith, at high production speeds V.

If a rotary printing press is intended to be operated at high production speeds V, for example at 6.5 m/s, or in particular at 10 m/s or more, in an embodiment of the present invention, which is not specifically represented, it is also possible to do without the above mentioned regulation of the temperature T as a function of the production speed V, and to basically provide the temperature regulation of the structural component 03, and in particular of the forme cylinder 03 or a maximum value $T_{MAX}$ of more than 30° C., in particular greater than or equal to 32° C., for example a temperature T of 32 to 37° C.

With the temperature regulation of the forme cylinder 03, and in particular with the temperature regulation in the areas near the surface, or of the printing forme 04, to above 30° C., scum-free printing is possible in high ranges of the production speed, in contrast to the prior practice, without the printing forme 04 becoming plugged with printing ink, and without fibers and/or dust from the material 09 to be imprinted being introduced into the printing group 01 via the transfer cylinder 07. An outlay which would result in a separate temperature regulation of the forme cylinder 03 to maintain a low temperature, and additionally of the transfer cylinder 07, to maintain a higher temperature, is avoided, in an advantageous manner, by the present selection of the temperature T of the forme cylinder 03. Besides, by temperature regulation from the interior of the cylinder by the use of a fluid, for example a liquid, a large outlay for housings, air-conditioning and exhaust air cleaning can be avoided. Such a large outlay would be required, for example, in case of a convective cooling of the outward oriented side of the printing forme 04 covered with printing ink. Therefore, in an advantageous embodiment, a temperature-regulating flow through the forme cylinder 03 can occur, which can either be regulated in its mass flow or, in an advantageous manner, via its temperature.

There never is a tackiness outside of the desired or the preset tack value, in connection with the possibly low production speed V, during the start-up procedure, if defined time intervals and the correct time for pre-running are maintained, or when switching in the temperature regulation during increased production speed V and the heating connected therewith.

Criteria for the way in which the use of the described method leads to an advantageous use, are the characteristics of the printing ink used in respect to the tackiness as a function of the production speed V on the one hand and, on the other, of the temperature T. A suitable characteristic has been represented by way of example in FIG. 5.

This is a printing ink which, in connection with the present method, does not fall below a tack value of 4 and does not exceed a tack value of 23 in the entire range of the production speed V from 1 m/s to 16 m/s, and in particular from 3 to 16 m/s, and/or a temperature between 15° to 50°, and in particular between 15° to 40°. Ideally, the tack value for the range of the production speed V between 3 and 16 m/s, or at a temperature between 22° and 50° C. lies in a range between 6 to 9.5 tack, and in particular between 7 and 8.5 tack.

For both dependencies, the characteristic of the ideal printing ink extends horizontally, i.e. the gradients dtack/dV and/or dtack/dT are approximately 0 in the range of interest for production, for example from 15° to 50°, and in particular 22° to 50°, and between 1 and 16 m/s, in particular 3 to 16 m/s.

Within a temperature range between 22° to 50° C., the printing ink shows a dependence of the tackiness from the temperature T, so that an amount of the gradient dtack/dT is maximally 0.6 tack/° C. (−0.6 to +0.6), in particular less than or equal to 0.3 tack/° C. (−0.3 to +0.3). For temperature ranges greater than 30° C., the amount of the gradient dtack/dt is, in an advantageous manner, less than or equal to 0.2 tack/° C. (−0.2 to +0.2). In one embodiment of the printing ink, the dependence of the tackiness from the temperature T is provided as a falling curve, the gradient dtack/dT here lies between −0.6 and 0 tack/° C., and in particular lies between −0.3 and 0, for the mentioned temperature range of 22° to 50°.

In the range of production speeds V of 3 to 16 m/s, at least 9 to 14 m/s, the dependence of the tackiness from the production speed V is such that the amount of the gradient dtack/dV is maximally 1.5 tack* m/s (−1.5 to +1.5), and in particular less than or equal to 1 tack* m/s (−1 to +1). For production speeds V above 6 m/s, in an advantageous embodiment, the amount of the gradient dtack/dV is less than or equal to 0.5 tack* m/s (−0.5 to +0.5). In one embodiment of the printing ink, the dependence of tackiness from the production speed V is embodied as a rising curve, the gradient dtack/dV here lies between +1.5 and 0 tack* m/s, and in particular between +1 to 0, for the mentioned range.

Figure 5:
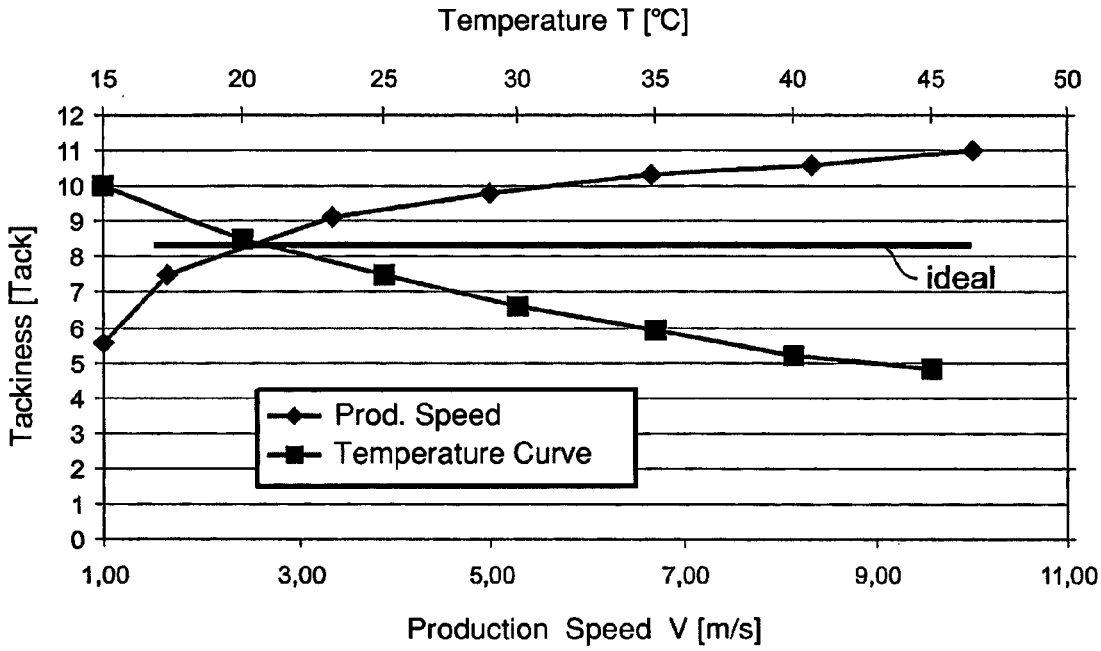

The courses of the two dependencies represented in FIG. 5 in the respective interval considered are advantageously monotonously rising or falling, and preferably each have a gradient or a slope of opposite sign.

The printing ink is advantageously employed in the above mentioned printing group, or in the above mentioned rotary printing press, which has at least one structural component 03, 07, 12, 13, 14, which works together with a printing ink and which is controllable by a temperature regulating device 18, 19. The printing group 01 is embodied as a printing press for planographic printing, and in particular for waterless planographic printing. However, it can also be configured for direct or indirect planographic printing.

While preferred embodiments of a method for operating a printing group and to the use of a printing ink, in accordance with the present invention, have been set forth fully and completely hereinabove, it will be apparent to one of skill in the art that various changes in, for example, the overall sizes of the cylinders, the cylinder drives and the like could be made without departing from the true spirit and scope of the present invention which is accordingly to be limited only by the appended claims.

What is claimed is:

1. A method for operating a printing group for planographic printing including:

providing at least one rotating structural component in said printing group;

providing means for adjusting a temperature of said at least one rotating structural component;

supplying printing ink to said at least one rotating structural component;

providing a production speed of said at least one rotating structural component;

providing a temperature regulating device for regulating said temperature of said at least one rotating structural component as a function of said provided production speed; and maintaining a tackiness of said ink on said rotating structural component within a range of acceptable tack values by regulating said temperature of said at least one rotating structural component as said function of said provided production speed of said at least one rotating structural component.

2. The method of claim 1 further including providing a control device for said temperature regulating device.

3. The method of claim 2 further including selecting a temperature greater than 30° C. for a production speed of at least 10 m/s.

4. The method of claim 2 further including setting said temperature in said temperature regulating device at greater than 30° C. for a production speed at least equal to 30 m/s.

5. The method of claim 1 wherein said at least one rotating structural component is a printing group cylinder.

6. The method of claim 5 wherein said printing group cylinder is a forme cylinder which is temperature regulated by said temperature regulating device.

7. The method of claim 6 further including selecting a temperature greater than 30° C. for a production speed of at least 10 m/s.

8. The method of claim 6 further including setting said temperature in said temperature regulating device at greater than 30° C. for a production speed at least equal to 30 m/s.

9. The method of claim 5 wherein said printing group cylinder is a transfer cylinder which is temperature regulated by said temperature regulating device.

10. The method of claim 5 further including selecting a temperature greater than 30° C. for a production speed of at least 10 m/s.

11. The method of claim 5 further including setting said temperature in said temperature regulating device at greater than 30° C. for a production speed at least equal to 30 m/s.

12. The method of claim 1 further including providing said printing group for waterless planographic printing.

13. The method of claim 12 further including using said temperature regulating device for controlling a tackiness of said printing ink between 6 and 9.5 tack in connection with production speeds between 10 m/s and 16 m/s.

14. The method for operating a printing group for planographic printing in accordance with claim 1 further including providing a material to be imprinted as a paper with a coating weight of no greater than 20 g/m$^2$, operating said printing group at a production speed of at least 10 m/s and setting said temperature to one of a reference variable and a maximum value greater than 30° C.

15. The method of claim 14 further including operating said printing group using an indirect printing process.

16. The method of claim 14 further including regulating said temperature from an interior of said rotating structural component using a fluid.

17. The method of claim 14 further including providing said material to be imprinted as newsprint.

18. The method of claim 14 further including providing said temperature-regulating device from a control device with one of said reference variable and said maximum value, which is not to be exceeded, as a command value.

19. The method of claim 18 further including supplying said control device with an actual production speed as the command value and determining said one of said reference variable and said maximum value using an interrelationship between said actual production speed and a reference value for said temperature.

20. The method of claim 14 further including maintaining a tackiness of said printing ink constant by temperature-regulating said rotating structural component.

21. The method of claim 14 further including providing a mean tack value for said printing ink and varying an actual tackiness from said mean tack last value by no greater than ±25%.

22. The method of claim 1 further including operating said printing group using an indirect printing process.

23. The method of claim 1 further including regulating said temperature from an interior of said rotating structural component using a fluid.

24. The method of claim 1 further including providing a material to be imprinted as a paper with a coating weight of no greater than 20 g/m$^2$.

25. The method of claim 1 further including providing a material to be imprinted as newsprint.

26. The method of claim 1 further including changing one of a reference variable and a maximum value for said temperature-regulating device for setting the tackiness of said printing ink.

27. The method of claim 1 further including maintaining a tackiness of said printing ink constant by temperature-regulating said rotating structural component.

28. The method of claim 1 further including providing a mean tack value for said printing ink and varying an actual tackiness from said mean tack last value by no greater than ±25%.

29. The method of claim 1 further including using said temperature regulating device for controlling a tackiness of said printing ink between 6 and 9.5 tack in connection with production speeds between 10 m/s and 16 m/s.

30. The method of claim 1 further including providing said at least one rotating structural component as a roller which is temperature-regulated by said temperature-regulating means.

31. The method of claim 30 further including providing said roller as a screen roller.

32. The method of claim 1 further including providing said printing ink having a tack and providing a characteristic in a temperature range between 22° and 50° having a tackiness having a gradient of 0.6 tack/° C.

33. The method of claim 32 further including providing said gradient at a production speed of between 9 to 14 m/s and a temperature between 22° and 50° C.

* * * * *